US011619437B2

(12) United States Patent
Bostic, Jr. et al.

(10) Patent No.: US 11,619,437 B2
(45) Date of Patent: Apr. 4, 2023

(54) EVAPORATOR DEFROST BY MEANS OF ELECTRICALLY RESISTIVE COATING

(71) Applicant: STANDEX INTERNATIONAL CORPORATION, Salem, NH (US)

(72) Inventors: Teddy G. Bostic, Jr., Summerville, SC (US); Jonathan Matthew Kolaski, Ridgeville, SC (US); John Lee Warder, Somerville, MA (US)

(73) Assignee: Standex International Corporation, Salem, NH (US)

( * ) Notice: Subject to any disclaimer, the term of this patent is extended or adjusted under 35 U.S.C. 154(b) by 559 days.

(21) Appl. No.: 16/777,995

(22) Filed: Jan. 31, 2020

(65) Prior Publication Data

US 2020/0248952 A1 Aug. 6, 2020

Related U.S. Application Data

(60) Provisional application No. 62/799,960, filed on Feb. 1, 2019.

(51) Int. Cl.

| | |
|---|---|
| ***F25D 21/08*** | (2006.01) |
| ***F25B 47/02*** | (2006.01) |
| ***H05B 3/28*** | (2006.01) |
| ***H05B 3/14*** | (2006.01) |
| ***H05B 3/18*** | (2006.01) |

(52) U.S. Cl.

CPC ..... *F25D 21/08* (2013.01); *F25B 47/02* (2013.01); *H05B 3/145* (2013.01); *H05B 3/18* (2013.01); *H05B 3/286* (2013.01)

(58) Field of Classification Search

CPC ..... F25D 21/08; F25B 47/02; F25B 39/02; H05B 3/18; H05B 2214/02; H05B 3/145; H05B 3/286; H05B 2214/04; H05B 3/26; F28F 17/00; F28F 1/325; F28F 13/182; F28D 1/0477; F28D 2021/0071

See application file for complete search history.

(56) References Cited

U.S. PATENT DOCUMENTS

| | | | | |
|---|---|---|---|---|
| 8,581,158 | B2 | 11/2013 | Heintz et al. | |
| 8,581,758 | B2 * | 11/2013 | Teramoto | H03K 19/00361 341/101 |
| 8,664,573 | B2 | 3/2014 | Shah et al. | |
| 8,962,736 | B2 | 2/2015 | Law | |
| 9,062,906 | B2 * | 6/2015 | Khosla | G05D 23/193 |
| 2005/0035110 | A1 * | 2/2005 | Petrenko | B64D 15/22 219/202 |
| 2018/0094848 | A1 * | 4/2018 | Jung | F25D 21/06 |
| 2019/0226750 | A1 * | 7/2019 | Kang | H05K 1/097 |

OTHER PUBLICATIONS

Phillips, et al., "The Effect of Graphite and Carbon Black Ratios on Conductive Ink Performance," J Mater Sci, vol. 52, pp. 9520-9530 (2017).

* cited by examiner

*Primary Examiner* — Ana M Vazquez
(74) *Attorney, Agent, or Firm* — Saxton & Stump, LLC

(57) ABSTRACT

A defrosting system for defrosting an evaporator assembly is disclosed. The system includes the evaporator assembly, an electrically resistive coating having an electrically insulative matrix and a conductive doping agent disposed on at least one surface of the evaporator assembly, and a plurality of electrical terminals arranged and disposed to supply electricity to the electrically resistive coating. A method for defrosting an evaporator assembly and a coating for heating evaporator assemblies are also disclosed.

19 Claims, 5 Drawing Sheets

EVAPORATOR DEFROST BY MEANS OF ELECTRICALLY RESISTIVE COATING

FIELD OF THE INVENTION

This invention relates to automatic defrost technology for refrigeration equipment, in particular, defrosting refrigeration evaporator coils and associated conductive fins by means of an electrically resistive coating.

BACKGROUND OF THE INVENTION

In standard refrigeration equipment, the heat absorbing element of the cooling technology and other cooled surfaces will continually accumulate liquid condensate or frost from atmospheric moisture rendering the system less efficient and inconvenient to maintain. A variety of automated defrost technologies are employed to eliminate frost buildup but these generally require heating the surfaces for a brief period thus raising the air and product temperature within the freezer. For some devices, this temperature variation exceeds the acceptable limits required to maintain product viability.

In the area of refrigeration, the typical defrosting cycle is achieved through the heating of a discrete electrical heating element in close contact or in the vicinity of the evaporator element or by means of bypassing hot refrigerant from the condenser circuit which is connected to the evaporator in a similar manner to a typical discrete electrical heating element. There are also a variety of additional methodologies employing variants of these methods. These types of systems tend to be inefficient with energy utilization and unequal in energy distribution applied to the melting or sublimation of ice.

There is not found in the prior art a method for the utilization of achieving a conformal coating electrically resistive heating element that would allow for high levels of evaporator area coverage and highly uniform heating.

The disclosed method utilizes a conformal coating applied to an evaporator that is electrically resistive and can thus be utilized as a defrosting element with the advantages of high surface area coverage and high heat distribution uniformity.

SUMMARY OF THE INVENTION

Embodiments of the present invention include the controlled usage of an electrically conductive coating to melt or vaporize frost accumulation or ice buildup.

Other embodiments of the present invention include a defrosting system for defrosting an evaporator assembly. The system includes the evaporator assembly, an electrically resistive coating having an electrically insulative matrix and a conductive doping agent disposed on at least one surface of the evaporator assembly, and a plurality of electrical terminals arranged and disposed to supply electricity to the electrically resistive coating.

Still other embodiments of the present invention include a method for defrosting an evaporator assembly. The method includes providing an evaporator assembly comprising an electrically resistive coating having an electrically insulative matrix and a conductive doping agent disposed on at least one surface of the evaporator assembly and a plurality of electrical terminals arranged on a surface of the electrically resistive coating. Electricity is supplied to the electrically resistive coating to heat ice or water present on the electrically resistive coating.

It is an aspect of the invention to provide an electrically resistive heating element that conforms to the shape of the evaporator tubing and fin construction.

Another aspect of the invention is to provide an electrically resistive heating element that conforms to the shape of any cooling element technology including thermoelectric and magnetic types of technologies and the associated heat exchanging elements.

Still another aspect of the invention is to provide a refrigeration defrost system that can be adapted for any freezer or refrigerator.

Another aspect of the invention is to provide an electrically resistive heating element that conforms to the shape of any cooling element that can have electrical terminals attached to the conformal coating in a variety of positions to energize the electrically resistive coating.

Still another aspect of this invention is to create a defrost heating capability that can be energized for very short durations relative to other technologies which provides the ability to remove frost accumulation more frequently due to the uniform and high intensity heating capability of certain conductive carbon nanotube-containing electrically resistive coatings.

Other features and advantages of the present invention will be apparent from the following more detailed description, taken in conjunction with the accompanying drawings which illustrate, by way of example, the principles of the invention.

BRIEF DESCRIPTION OF THE DRAWINGS

Wherever possible, the same reference numbers will be used throughout the drawings to represent the same parts.

DETAILED DESCRIPTION OF THE INVENTION

Figure 1:
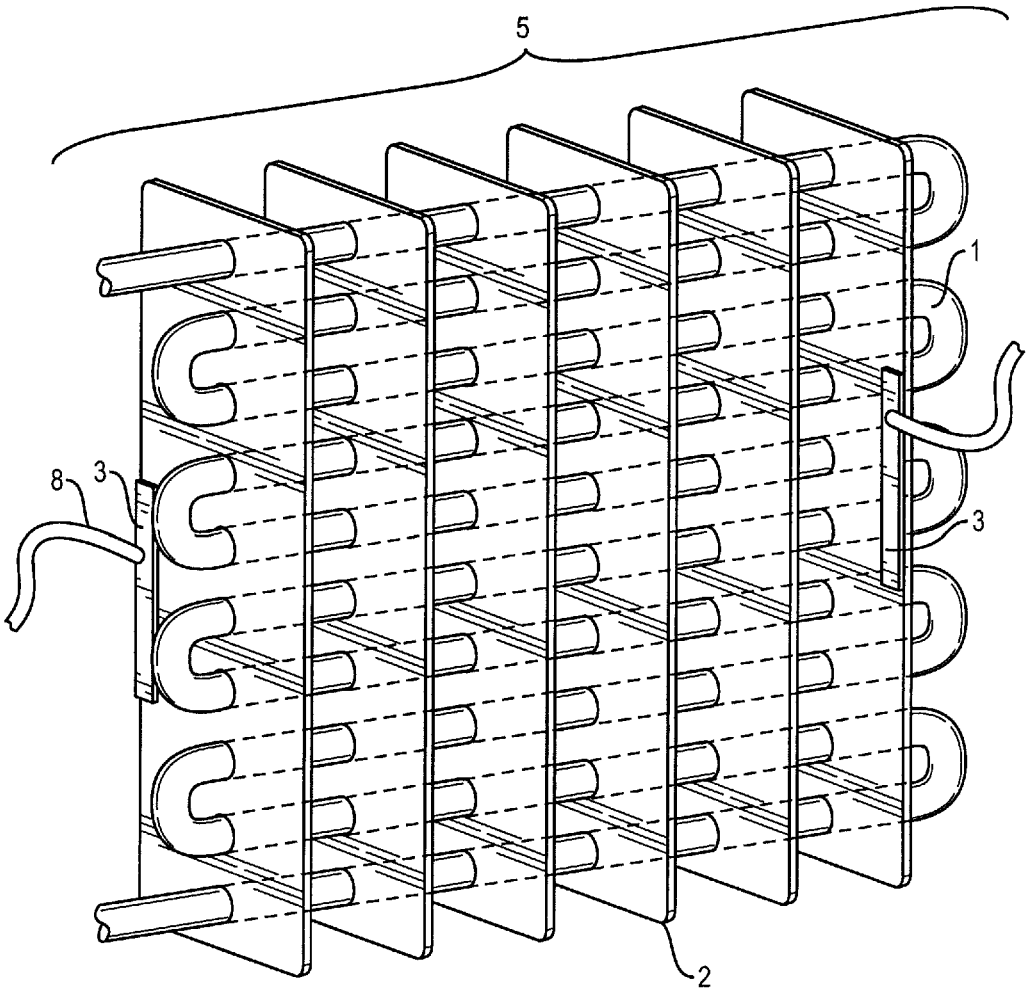
FIG. 1 is an isometric illustration showing a standard evaporator utilizing tube and fin construction also showing electrical terminal connections in contact with the electrically resistive coating.
Figure 2:
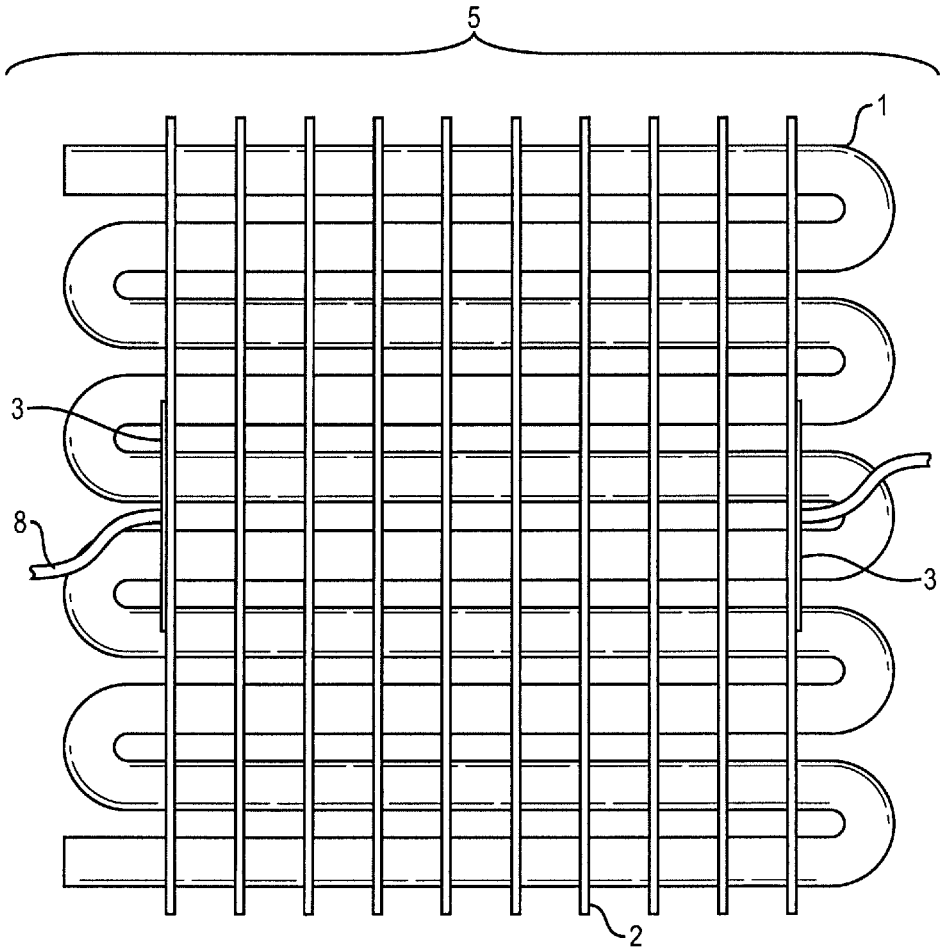
FIG. 2 is a front facing illustration showing a standard evaporator utilizing tube and fin construction also showing electrical terminal connections in contact with the electrically resistive coating.
Figure 3:
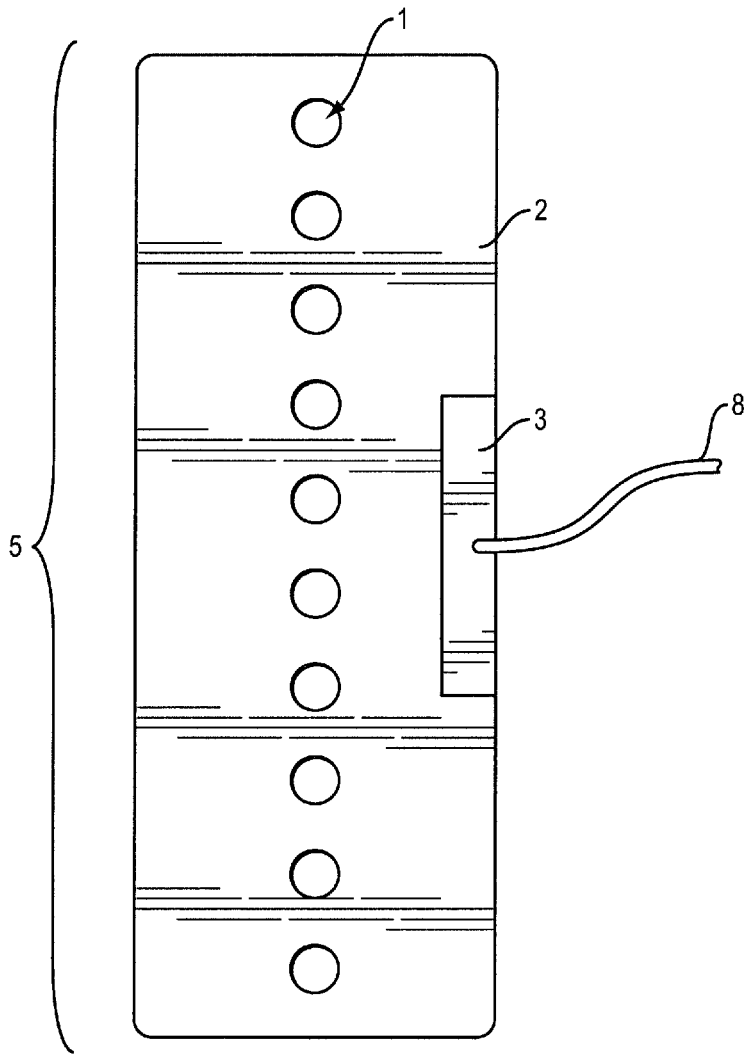
FIG. 3 is a side view illustration showing a standard evaporator utilizing tube and fin construction also showing electrical terminal connections in contact with the electrically resistive coating.

The invention generally relates to the field of refrigeration and the ability to apply heating energy directly or indirectly to the evaporator element within a refrigeration system in order to affect defrost cycling.

Embodiments of the invention function in a superior way compared to other electrical defrost technologies due to the more even and effective distribution of active heating elements.

Functionally, a conformal coated evaporator will more uniformly, efficiently, conveniently and quickly remove ice or condensation from complex geometries, such as that of a typical vapor cycle refrigeration system evaporator, but the advantages are realized on most geometries. Most existing technologies utilize a resistive element concentrated at one location on or near the cooling element in a refrigeration system. These existing systems rely on free convection and conduction from one location to raise the overall temperature of the cooling element. This causes uneven heating, frequently un-melted ice and a generally inefficient use of energy.

The utilization of a conformal coating allows for a direct application of energy to the affected area and a secondary heat transport mechanism (conduction and/or convection) is not required. The heat generated is directly absorbed by the ice or water providing the latent heat necessary for phase change and ultimately the removal of the ice or water by direct run off, vaporization or accelerated sublimation at lower powers. The application of electrical power to the conformal coating is multivariant function of the defrosting application. Electrical current can be applied as direct current (DC), alternating current (AC) modulating voltage, amperage or frequency or as a digitally controlled pulse width modulation (PWM) controlling amplitude, pulse length, time-off length and any macro variation in the application of the pulse profile over time (i.e. adjusting up or down any of the variables over a period of time and then reverting to another state). For example, the supplying electricity may include applying electricity for up to about 30 minutes or up to about 20 minutes or up to about 10 minutes or up to about 5 minutes or from about 10 seconds to about 30 minutes or from about 30 seconds to about 20 minutes or from about 1 minute to about 10 minutes or from about 5 minutes to about 10 minutes or about 10 minutes. In another embodiment, the electricity is applied for short time durations to constantly ablate ice crystals as they accumulate to prevent ice buildup. For example, the supplying electricity may include repeatedly applying electricity as up to about 10 microseconds, or from about 1 to about 10 microsecond pulses or from about 2 to about 8 microseconds or from about 4 to about 6 microseconds. The repeated pulses in this embodiment may be provided for up to 10 pulses or up to 100 pulses or up to 1000 pulses or more. It is through the strategic use of these various power application strategies that maximum effectivity for condensate evaporation, frost melting, or high frequency moisture ablation can be affected.

The preferred application of electrical power as described above is dependent on the refrigeration or freezer application and the required ice or condensate mass removal. To this point the following situational strategies are identified:

1. Timed defrost (heavy frost, ice or liquid condensate removal)—In this case, the electrically resistive coating 6 is energized by a continuous direct or alternating current for a period of time.
2. Variable intensity, periodic, timed defrost (heavy to light frost, ice or liquid condensate removal)—In this case, it is preferred that the electrically resistive coating 6 is energized by a continuous direct current at 48V or less modulating a percentage of time energized using PWM.

Figure 5:
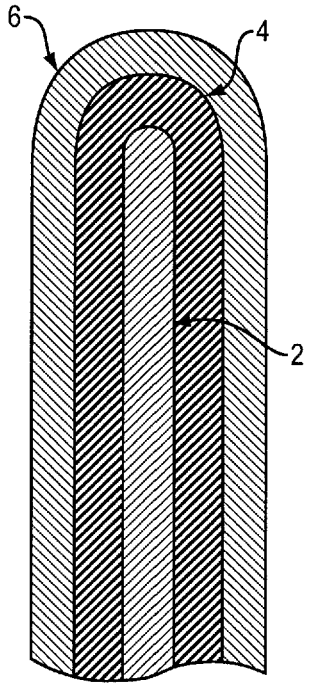
FIG. 5 is an illustration showing the layers of coating covering an evaporator fin element, according to an embodiment of the invention.

Referring now to FIG. 1, the preferred embodiment of the invention is illustrated with a power supply to the unit as power cord 8. The evaporator is shown as being comprised of tubes 1, that circulate cold refrigerant which can be constructed of numerous materials such as copper, steel, aluminum, other metals, or non-metals, such as plastics, with copper being the preferred material. Attached to the tubes 1, by separable or inseparable methodologies are a plurality of fins 2, with fins being spaced between 0.06" to 0.50" which can be constructed of numerous materials, such as copper, steel, aluminum, other metals or non-metals, such as plastics, with aluminum being the preferred material. Applied to the evaporator assembly 5, is an optional electrically insulating coating 4, and an electrically resistive coating 6 (See FIGS. 5 and 6.)

The electrically resistive coating 6, according to the present invention, includes an electrically insulative matrix and a conductive doping agent. The electrically insulative matrix may advantageously include an electrically insulating polymer and provides a matrix having electrically insulative properties. Suitable compounds for use as the electrically insulating polymer include, but are not limited to, urethane, epoxy, silicone, polyacrylamides, polyvinyl alcohol among other polymer matrix bases, and combinations thereof. A particularly suitable electrically insulating polymer includes urethane. The conductive doping agent includes a material having electrically conductive properties and, when utilized, in combination with the electrically insulative matrix, provides resistive heating upon application of electricity to the electrically resistive coating 6. Suitable compounds for use as the conductive doping agent include, but are not limited to, carbon nanotubes, graphene, graphite, carbon black, metal, combinations thereof, and other compounds providing similar electrically conductive properties in an electrically insulating polymer. A particularly suitable conductive doping agent includes carbon nanotubes (CNTs). Suitable loadings for the conductive doping agent in the electrically resistive coating 6 include a loading that provides an electrical resistance suitable for forming a resistive heating element upon application of electricity. The loading provides a highly effective and homogeneous heating element. The loading concentration of the conductive doping agent may vary from about 0.001 wt % to 70 wt % or 20 wt % to about 70 wt % or 30 wt % to about 60 wt % or from about 40 wt % to 50 wt % or from about 0.001 wt % to 50 wt % or from about 0.001 wt % to 40 wt % or from about 0.001 wt % to 20 wt % or from about 0.001 wt % to 5 wt % or from about 0.5 wt % to 5 wt % or from about 1 wt % to 5 wt % or from about 3 wt % to 5 wt % or about 3 wt % or about 4 wt % or about 5 wt % or about 25 wt % or about 30 wt % or about 40 wt % or about 50 wt % or about 60 wt % or about 70 wt % depending on the target electrical resistance and heat dissipation per unit area. Likewise, the conductive doping agent is provided in combination with an electrically insulative matrix having a compatible chemistry and provides resistive heating upon application of electricity. In one particularly suitable embodiment, the electrically resistive coating 6 includes from about 0.001 wt % to about 5.0 wt % carbon nanotubes as the conductive doping agent and urethane as the electrically insulative matrix. Another suitable embodiment, the electrically resistive coating 6 includes about 10 wt % to about 70 wt % carbon black as the conductive doping agent and urethane as the electrically insulative matrix. Another suitable embodiment includes a combination of carbon black and graphite in an amount of about 10 wt % to about 70 wt %. In addition, other conductive doping agents may be used in place of CNTs or in addition to the CNTs, including, but not limited to, graphene, graphite, carbon black, metal, and combinations thereof. Carbon nanotubes suitable for use with the present invention exhibit beneficial electrical, mechanical and thermal conductivity properties. Carbon nanotubes can be synthesized by a number of methods including carbon arc discharge, pulsed laser vaporization, chemical vapor deposition (CVD) and high-pressure carbon monoxide vaporization. Of these, carbon nanotube synthesis by CVD can provide bulk production of high purity and easily dispersible product. Other material variants of carbon nanotubes may be utilized. The carbon nanotubes can be any of single wall carbon nanotube, double wall carbon nanotube, multiwall carbon nanotube, or a mixture thereof, length, diameter, and chirality can vary according to processing methods, duration and temperature of the synthesis.

In one embodiment, the electrically resistive coating 6, according to the present invention, is formed by applying a coating of urethane-based carbon black containing composition, such as HeetCoat (available from SmartPaint, wwwsmartpaintsolutions.com), to the desired evaporator assembly 5 and permitting the composition to dry.

In addition, one or more additives may be provided to one or both of the electrically insulating coating 4 and the electrically resistive coating 6 in an amount of up to 20 wt %, or from about 0.01 wt % to about 10% or from about 0.1 wt % to about 5 wt % of the respective coating composition. Suitable examples of additives for use in embodiments of the present invention include, but are not limited to fillers, colorants, polymer additives (e.g., plasticizers, pH adjustment additives, etc.), antioxidants, clarifiers/nucleating agents, flame retardants, light stabilizers or other known additives for polymeric coatings.

The electrically insulating coating 4 can be optional in the case but not exclusively to the case that the electrically resistive coating 6 incorporates an electrically insulating property inherent to the coating technology. Also, on the assembly are a plurality of electrical terminals 3 made from copper sheet or copper wire that are used to supply electricity to the electrically resistive coating 6. This will, in turn, cause an elevation in the temperature of the electrically resistive coating 6. The electrical current applied can be either as direct current or alternating current. This is dependent as stated above in sections 1 and 2.

Figure 4:
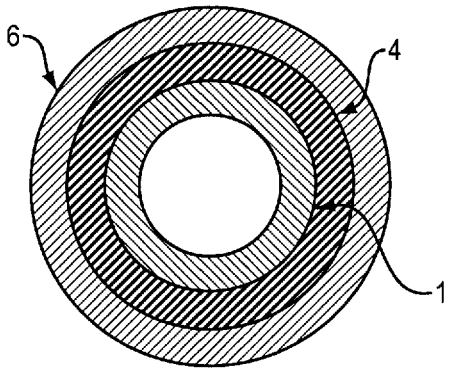
FIG. 4 is an illustration showing the layers of coating covering an evaporator tube, according to an embodiment of the invention.

Referring to FIG. 4 we now demonstrate typical representative cross sections of the evaporator assembly 5, tube 1, and fin 2, showing the applied optional electrically insulating coating 4, and the electrically resistive coating 6.

The enablement of the invention requires the application of the electrically insulating coating 4 and the electrically resistive coating 6 and the electrical terminals 3, used to energize the coating when electrical current is applied. The controlled application is achieved using conventional aerosolization and spraying equipment to apply layers in a controlled manner. In a typical application, the evaporator assembly 5 would be prepared using cleaning solvent or other method to ensure the surface will provide proper adhesion for the coatings. Cleaning can be achieved by spraying or immersing in weak acidic acid, manually scrubbing and rinsing with deionized water.

Once the evaporator assembly 5 is cleaned, it is positioned such that the areas of application are easily accessed. The application of coatings may be such that the evaporator assembly 5 is covered greater than 98%, or greater than 95%, or greater than 90%, or greater than 85% of the surface area of the fins and tubes. This level of coverage will allow for conducted heat to melt ice on adjacent, uncoated surfaces.

If required, the electrically insulating coating 4 is applied to the affected areas. The coating thickness can vary from 2 to 5 mils as long as the necessary dielectric value of 0.5 kV/mil to 2 kV/mil is achieved. The electrically insulating coating 4 may be applied at any suitable temperature and may include any suitable electrically insulating polymer or resin, such as polyurethane, polyester, silicone, epoxy, alkyd or acrylate, with polyurethane being the preferred coating. Aerosolized particle size control is not critical and most common painting systems easily achieve the necessary atomization and volumetric application requirements.

Following the application of the electrically insulating coating 4 or alternatively without the electrically insulating coating 4, in the case that the electrically resistive coating 6 is used. A preferred method does not include the use of electrically insulating coating 4. This method has intrinsic properties necessary to self-isolate from the metal substrate (thus achieving effectively a dielectric value of 0.5 kV/mil to 2 kV/mil) allowing for the omittance of the electrically insulating coating 4. The plurality of electrical terminals 3 are glued or attached by some other method, such as a compatible pre-applied pressure sensitive adhesive (pressure sensitive adhesive being the preferred method in place on the contacting side facing the electrically insulating coating 4 or the evaporator assembly 5, directly while a conductive surface on the other side of the electrical terminal 3 is exposed). The positioning of the electrical terminals 3 will be dependent on the geometry of the evaporator assembly. As a general rule, electrical terminals 3 are applied such that the majority of electrical terminals 3 are to be applied to electrically resistive coating 6 by volume and linear dimension evenly distributed and centered between the electrical terminals 3. This procedure enhances the uniformity of current flow through the electrically resistive coating 6 and, in turn, achieves a uniform heating of the electrically resistive coating 6 when current is applied. As a rule, the electrical terminal must be sized and positioned such that 90% of the end linear dimension is directly energized.

Following the application of the electrically insulating coating 4 or alternatively without the electrically insulating coating 4, in the case that the electrically resistive coating 6 is used. As previously noted, this has intrinsic properties allowing for the omittance of the electrically insulating coating 4 and the application of a plurality of electrical terminals 3. In this case, the electrically resistive coating 6 is then applied in the same basic manner as the electrically insulating coating 4. The application parameters (atomized particle size creation and distribution and the volumetric flow) can vary widely depending on the conductive particle loading percentage within the coating and the type and viscosity of the polymeric matrix. Conductive coatings using carbon nanotube (CNT) conductive particles, basic carbon particles or other particle types will have unique application parameters. The application of the electrically resistive coating 6 must be properly controlled to achieve a coverage area and nominal thickness that create the resistive properties required for the heating application. In the preferred application, an aerosolized particle size of 1 to 2 mils would be typical.

After all application processes are complete for the electrically insulating coating electrical terminals 3, and the electrically resistive coating 6, the evaporator assembly 5 can be installed in the overall refrigeration system and the electrically resistive coating 6 energized accordingly.

Figure 6:
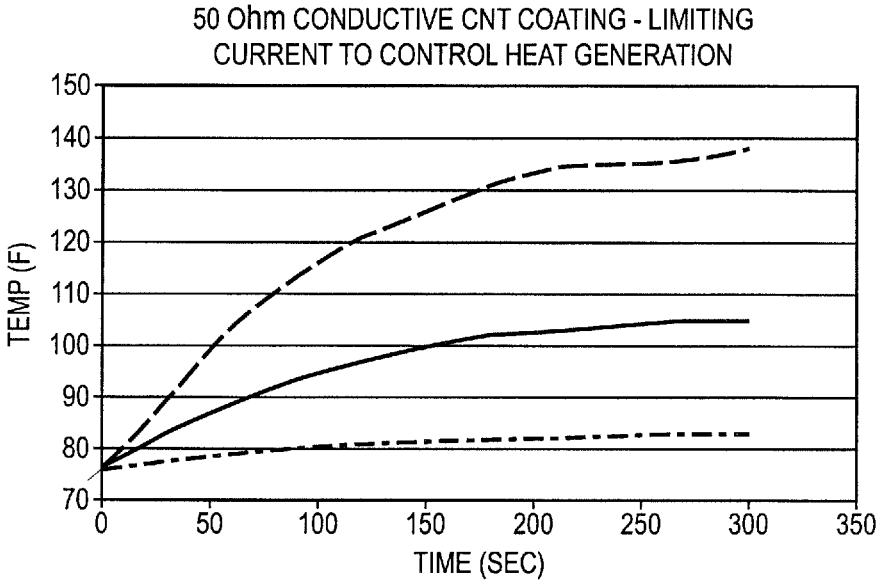
FIG. 6 is a characteristic set of curves demonstrating the temperature rise on a coated surface as a function of time for three levels of electrically conductive carbon nanotube CNT concentrations.

In an example referencing FIG. 6, we demonstrate that practical % CNT loading of a polymer coating (loading can vary dramatically and greatly affect conductivity) very high temperatures can easily and quickly be achieved. In FIG. 6 we demonstrate that a temperature rise of 30° F. can be achieved in less than 2 minutes on an ice coated surface.

Figure 7:
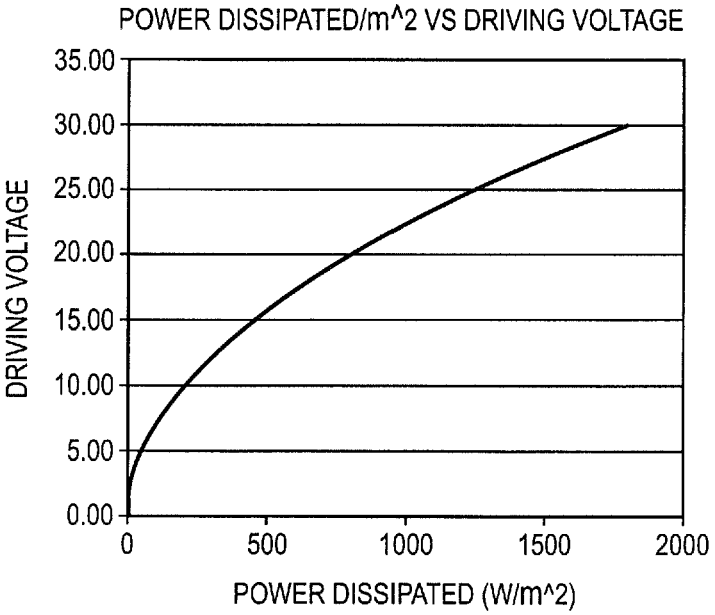
FIG. 7 is a characteristic curve demonstrating a typical relationship between driving voltage and power dissipated per unit area for a coated surface.

FIG. 7 demonstrates the performance of an exemplary CNT conductive coating dissipating heat as a function of aspect ratio (length to width ratio of the element area between the electrical contact areas). For a given aspect ratio (length to width ratio) a specific electrical resistance is achieved. Resistances of 2 to 80 ohms per square meter are readily achieved and can be formulated to best serve the application. In FIG. 7 we demonstrate a readily formulated CNT conductive coating that can generate very high-power dissipation per unit area at very low voltage. Low voltage in this application is considered to be less than 48V.

While the invention has been described with reference to one or more embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims. In addition, all numerical values identified in the detailed description shall be interpreted as though the precise and approximate values are both expressly identified.

What is claimed is:

1. A defrosting system for defrosting an evaporator assembly, the system comprising:

the evaporator assembly;

an electrically resistive coating comprising an electrically insulative matrix and a conductive doping agent disposed on at least one surface of the evaporator assembly;

a plurality of electrical terminals arranged and disposed to supply electricity to the electrically resistive coating; and an electrically insulating coating disposed between the at least one surface of the evaporator assembly and the electrically resistive coating.

2. The defrosting system according to claim 1, wherein the electrically insulating coating includes urethane.

3. The defrosting system according to claim 1, wherein the electrically insulative matrix includes an insulating polymer.

4. The defrosting system according to claim 3, wherein the insulating polymer is selected from the group consisting of urethane, epoxy, silicone, polyacrylamides, polyvinyl alcohol, and combinations thereof.

5. The defrosting system according to claim 1, wherein the conductive doping agent is selected from the group consisting of carbon nanotubes, graphite, graphene, carbon black, metak, and combinations thereof.

6. The defrosting system according to claim 1, wherein the electrically resistive coating includes from about 0.001 wt % to about 5 wt % conductive doping agent.

7. The defrosting system according to claim 6, wherein the conductive doping agent comprises carbon nanotubes.

8. The defrosting system according to claim 6, wherein the conductive doping agent comprises carbon black.

9. The defrosting system according to claim 1, wherein the electrically resistive coating includes from about 20 wt % to about 70 wt % conductive doping agent.

10. The defrosting system according to claim 1, wherein the evaporator assembly includes at least one fin and at least one tube.

11. The defrosting system according to claim 10, wherein at least 95% of the area of the at least one fin and at least one tube are coated with the electrically resistive coating.

12. The defrosting system according to claim 1, wherein the evaporator assembly includes copper, steel, aluminum, or a non-metal.

13. A method for defrosting an evaporator assembly comprising:

providing an evaporator assembly comprising an electrically resistive coating comprising an electrically insulative matrix and a conductive doping agent disposed on at least one surface of the evaporator assembly, an electrically insulating coating disposed between the at least one surface of the evaporator assembly and the electrically resistive coating, and a plurality of electrical terminals arranged on a surface of the electrically resistive coating; and supplying electricity to the electrically resistive coating to heat ice or water present on the electrically resistive coating.

14. The method of claim 13, wherein the supplying electricity includes applying continuous direct or alternating current.

15. The method of claim 14, wherein the supplying electricity includes applying electricity for a predetermined time.

16. The method of claim 14, wherein the supplying electricity includes applying electricity for about 10 seconds to about 30 minutes.

17. The method of claim 14, wherein the supplying electricity includes repeatedly applying electricity as about 1 to about 10 microsecond pulses.

18. The method of claim 13, wherein the supplying electricity includes energizing the electrically resistive coating with an electrical current applied as pulse width modulation.

19. The method of claim 13, wherein the supplying electricity includes energizing the electrically resistive coating with an electrical current applied at a voltage of 48 volts or less.

* * * * *